United States Patent [19]

Cheatham

[11] Patent Number: 4,509,755

[45] Date of Patent: Apr. 9, 1985

[54] VERSATILE PLURALITY MIXER WITH RAPID CHANCE LOT CYCLING AND LOCKING MEANS

[76] Inventor: James S. Cheatham, 11 Hunter St., Ossining, N.Y. 10565

[21] Appl. No.: 607,591

[22] Filed: May 7, 1984

[51] Int. Cl.[3] ..... A63F 7/04

[52] U.S. Cl. ..... 273/144 B

[58] Field of Search ..... 273/144, 145

[56] References Cited

U.S. PATENT DOCUMENTS

| | | | |
|---|---|---|---|
| 502,876 | 8/1893 | Cahoon, Jr. | 273/145 C UX |
| 2,103,151 | 12/1937 | Dietrich | 273/144 B X |
| 2,216,526 | 10/1940 | Watson | 273/144 B |
| 3,204,345 | 9/1965 | Buckner | 273/145 C |
| 4,225,138 | 9/1980 | Wolf | 273/144 B X |
| 4,273,335 | 6/1981 | Allonsius | 273/144 B |

FOREIGN PATENT DOCUMENTS

| | | | |
|---|---|---|---|
| 148995 | 3/1952 | Australia | 273/144 B |
| 1077300 | 4/1954 | France | 273/144 B |
| 94711 | 9/1959 | Norway | 273/144 B |
| 481 | of 1900 | United Kingdom | 273/144 B |
| 121801 | 12/1918 | United Kingdom | 273/144 B |
| 384415 | 12/1932 | United Kingdom | 273/144 B |

*Primary Examiner*—Paul E. Shapiro

*Attorney, Agent, or Firm*—Michael I. Kroll

[57] ABSTRACT

According to the present invention a portable hand held indicia selector is provided comprising an enclosed mixing housing with multiple numbered indicia spheres contained within the housing. The spheres are directed into a defined area of the mixing housing for viewing so that the directed numbered indicia may be used by the user to randomly select numbers. The housing has incorporated in it a locking device so that the directed numbered indicia are locked into position and may be released by the user into the mixing housing.

2 Claims, 6 Drawing Figures

Figure 1
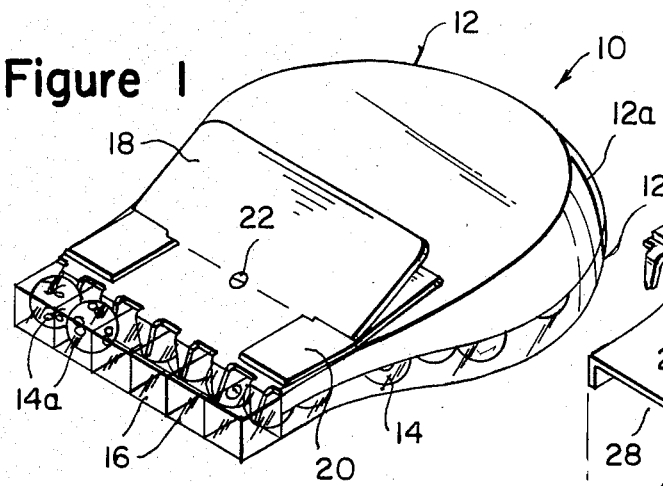
Figure 2
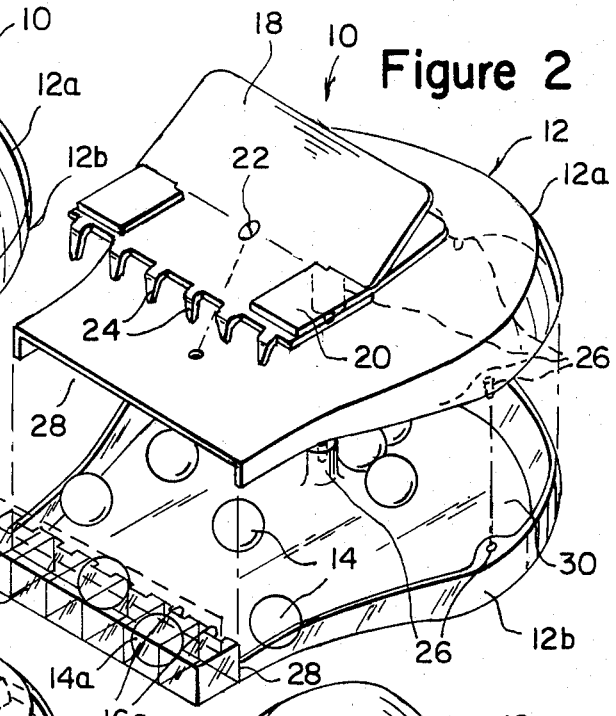
Figure 3
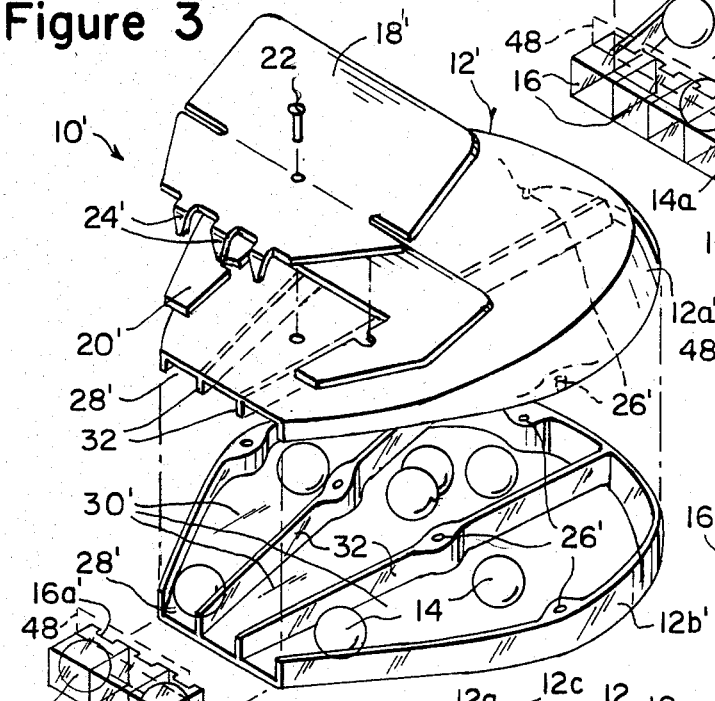
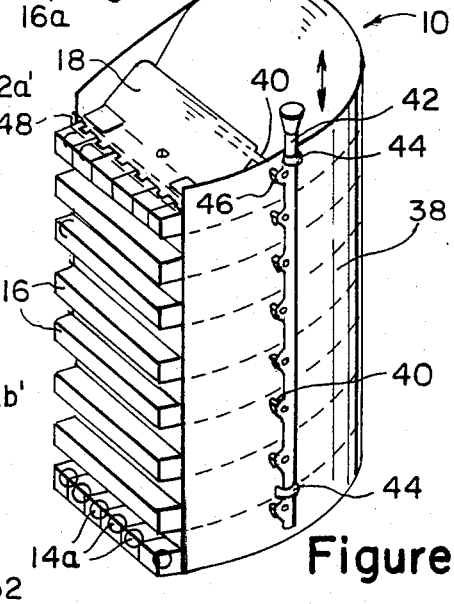
Figure 5
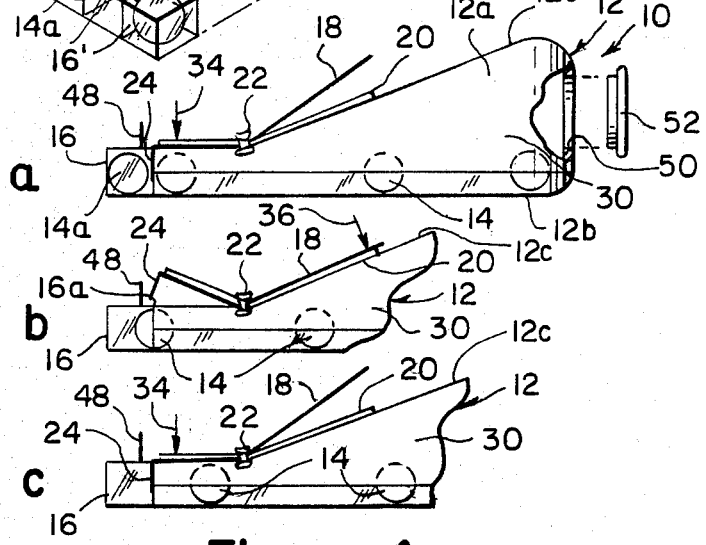
Figure 4
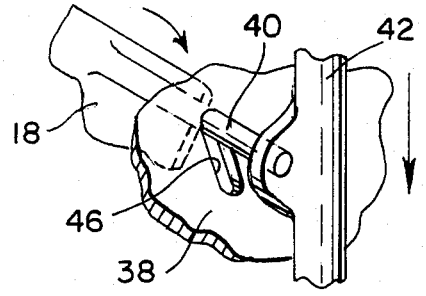
Figure 6

VERSATILE PLURALITY MIXER WITH RAPID CHANCE LOT CYCLING AND LOCKING MEANS

BACKGROUND OF THE INVENTION

1. Field of Invention

The instant invention relates generally to numerical selection apparatuses and more specifically it relates to a versatile plurality mixer with rapid chance lot cycling and locking means.

The desirability for providing chance devices to mix random plurality indicia spheres to produce chance lot combinations derived from marked plurality indicia spheres and store those chance lot indicia sphere results for use in lottery games has been recognized. Such devices are also particularly useful for playing similar games without the difficulty and toil required to mentally select random entries needed to compose chance lots that have different, non-repetitive combinations. The invention herein presents a fast and convenient user utility for obtaining types of lottery entries.

This invention is subject to a disclosure document filed in the U.S. Patent and Trademark Office under disclosure document No. 121,457 on Oct. 19, 1983.

2. Description of the Prior Art

Previous chance devices have been known for marked plurality indicia sphere mixing within a chamber, capturing and stacking of the plurality indicia spheres within chutes as a way to determine chance lots. Most have been objectionable in that they appear not to have sufficient mixer chamber volume relative to the plurality indicia sphere size to permit good random mixing. They also have inadequate locking mechanisms which rely on gravity to hold the spheres such that if the device is unintentionally inclined below a generally level position, chance results may be lost before the spheres markings can be viewed and recorded.

Unfavorable manipulation of prior devices after agitation and mixing to capture individual indicia spheres and to loosen jammed and stuck indicia spheres may delay and frustrate the operator of the mixer after a period of time. Previous designs do not readily permit variations in construction layout for different game configurations and selection conveniences because such previous devices grow awkwardly out of size especially for intended hand-held use. Coincidentally, if some of the previous chance devices were manufactured, costs of production might well be prohibitive relative to their worth because of inherent complexity.

SUMMARY OF THE INVENTION

A principle object of the present invention is to provide a versatile plurality mixer with rapid chance lot cycling and locking means that has sufficient mixer chamber volume relative to the plurality indicia sphere size to permit good random mixing and actuation by convenient handling.

Another object is to provide a versatile plurality mixer with rapid chance lot cycling and locking means that has an adequate locking mechanism which relies on a resilient lock return and fingers to hold the spheres secure within cubical cells without further effort on the operator's part.

An additional object is to provide a versatile plurality mixer with rapid chance lot cycling and locking means that requires favorable manipulation of the device after agitation and mixing to capture individual marked indicia spheres since the design of the device is of a size especially intened for hand-held use.

A further object is to provide a versatile plurality mixer with rapid chance lot cycling and locking means that is economical in cost to manufacture.

A still further object is to provide a versatile plurality mixer with rapid chance lot that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

DESCRIPTION OF THE DRAWINGS

FIG. 1 of the drawing shows a perspective view of a first embodiment of the invention.

FIG. 2 of the drawing shows an exploded perspective view of FIG. 1.

FIG. 3 of the drawing shows an exploded perspective view of a second embodiment of the invention.

FIG. 4*a* of the drawing shows a side view of the first embodiment with parts broken away.

FIG. 4*b* of the drawing shows a partial side view similar to FIG. 4*a* with the lock control in a releasing position.

FIG. 4*c* of the drawing shows a partial side view similar to FIG. 4*a* with the lock control in a locking position.

FIG. 5 of the drawing shows a perspective view of stacking device for a number of mixers.

FIG. 6 of the drawings shows an enlarged perspective view of a portion of the stacking device in FIG. 5.

DETAILED DESCRIPTION OF THE PREFERRED EMBODIMENTS

Turning now descriptively to the drawings, in which similar reference characters denote similar elements throughout the several views, FIGS. 1, 2 and 4 illustrates a versatile plurality mixer 10 with rapid chance lot cycling and locking means. The mixer 10 consists of a masked and fully enclosed mixing housing 12, a plurality of multiple marked indicia opaque chance lot spheres 14, an assembly of transparent cubical cells 16, a bent lock control member 18, a resilient flat leaf spring 20 and a fastener 22 to aid in the rapid cycling and locking of the spheres 14*a* for display and as a convenient way to minimize mixer manipulation and lot selection drudgery while generating chance lot combinations for use in lotteries.

The masked and fully enclosed mixing housing 12 is composed of top and bottom halves 12*a* and 12*b* and is fabricated with one compartment 30. A side of the mixing housing 12 interfaces at 28 with the assembly of transparent cubical cells 16 such that the spheres 14 line-up with the cells 16 closely without jamming. The spheres 14*a* are all quickly dumped simultaneously into the single row of cubical cells 16 from the compartment 30 as the mixing housing 12 is inclined with cells 16 downward to permit rapid chance lot formation of spheres 14*a*.

The lock control member 18 has fingers 24 attached and each finger is dedicated to a cubical cell 16 in a manner allowing the lock control member 18 to move about the fastener 22 and extend all fingers 24 into each transparent cell through top slots 16*a* to hold each and all chance lot spheres 14*a* simultaneously within the transparent cells 16 for viewing and recording. A plate 48 can be transversely mounted across top of the cubical cells 16 and in front of the top slots 16*a* to protect the fingers 24.

The extended position of the lock control fingers 24 into the cells 16 as shown in FIG. 4*a* is maintained by the leaf spring 20 applying a force 34 with the aid of the fastener 22 and slope 12*c* of the mixing compartment 12. Lock control fingers 24 also provide a movable separation between the cells 16 and compartment 30 to permit mixing of spheres 14 and chance lot holding of spheres 14*a* without loss of chance results regardless of mixer compartment 12 handling positions.

Application of a force 36 in FIG. 4*b* to move the lock control member 18 about the fastener 22 retracts all lock control fingers 24 simultaneously out of all cells 16 to quickly dump all spheres 14*a* from the cells 16 into the compartment 30 as the mixing housing 12 is inclined with cells 16 upward.

After the dumping of spheres 14*a*, release of the force 36 will allow the force 34 to return the lock control member 18 to extend the fingers 24 into each cell 16 through the top slots 16*a* to provide separation from the compartment 30 as in FIG. 4*c*, for proper random agitation and mixing of the spheres 14.

After mixing of the spheres 14 in the compartment 30, activation of the lock control member 18 applies the force 36, as in FIG. 4*b*, to retract the fingers 24 and allows new chance lot spheres 14*a* to be dumped rapidly into all transparent cubical cells 16 when the mixing housing 12 is inclined with cells 16 downward.

Release of the force 36 allows the force 34, as shown in FIG. 4*a*, aided by the leaf spring 20, to again extend the lock control fingers 24 into cells 16 through top slots 16*a* to hold each and all new chance lot spheres 14*a* simultaneously within the transparent cells 16 as shown again to complete the cycle to obtain a new lot of marked spheres 14*a* for viewing and entering.

Multiple marks on the indicia opaque body of each chance lot sphere 14*a* within the transparent cubical cell assembly 16 facilitate the viewing of the chance lot spheres 14*a* from several directions as shown in FIG. 1.

Mixer manipulation to complete a cycle of agitation and mixing, holding, viewing, dumping and mixing again can be accomplished between mixing housing 12 in an inclined position without the need to invert the mixing housing. To aid the agitation and mixing process perturbators 26 are built into the compartment 30 which with adequate volume, assures that the spheres 14 are forced into random intermixing even during mild mixer agitations.

Placing of the spheres 14 into the mixing housing 12 can be done during mixer 10 assembly through the interface 28 before the cells 16 are attached to the interface 28. Upon attachment the cells 16 and interface 28 are permanently sealed. Another way of placing the spheres 14 into the mixing housing 12 is shown in FIG. 4*a*. An aperture 50 is placed at rear of top half 12*a* of mixing housing 12 with a cap 52 for sealing the aperture 50 after spheres 14 are placed within.

FIG. 3 shows a second embodiment of a mixer 10'. The mixer 10' contains a masked and fully enclosed plurality mixing housing 12' that is composed of top and bottom halves 12*a'* and 12*b'* and is fabricated with more than one compartment 30' depending on the lottery game the mixer 10' is intended for. The compartments 30' are divided by inner walls 32. Likewise the number of multiple indicia marked opaque lot spheres 14 contained within the compartments 30' will also be determined by intended game use. The cubical cells 16' in this embodiment consists of three joined with three respective compartments 30', while the cubical cells 16 in FIGS. 1 and 2 consits of six joined with one compartment 30. Other combinations of cubical cells and dividing inner walls 32 can be used as needed for different lottery games.

Versatility of the mixer 10 is shown in FIGS. 5 and 6 wherein mixer construction permits stacking of a number of mixers 10 within a stacking member 38 in a manner allowing manageable random agitation, mixing, dumping and viewing of multiple combinations of chance lot spheres 14 for rapid determination and recording of sufficient lottery chances to fill a complete game card as a result of one mixing. A joining arm 40 is connected to each of the lock control members 18 to control the marked plurality spheres 14*a* through the movable separation fingers 24 to simultaneously enter or exit the cubical cells 16 of all mixers 10 by actuation of a single stack lock control shaft 42 to operate the joining arms in unison. Each joining arm 40 extends through a slot 46 in the stacking member 38 to pivotally engage the stack lock control shaft 42 while the shaft 42 is held vertically in place by brackets 44.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A versatile plurality mixer with rapid change lot cycling and locking means which comprises:

(a) a mixing housing masked and fully enclosed having an opaque sloped to half member and a transparent bottom half member affixed to said top half member permitting inspection;

(b) a plurality of multiple marked indicia opaque chance lot spheres placed within said mixing housing;

(c) a single row of transparent cubical cells, each said cell having a top slot therein and said cells interfaced with a side of said mixing housing such that said spheres can enter said cubical cells when said mixing housing is inclined with said cells downward to permit rapid chance lot formation of said spheres and said spheres can exit said cubical cells when said mixing housing is inclined with said cells upward to permit mixing of said spheres within said mixing housing;

(d) means for locking said spheres simultaneously within said cubical cells for viewing and for unlocking said spheres simultaneously within said cubical cells so that said spheres can enter said mixing housing said means having a bent lock control member having a plurality of downwardly extending fingers, a fastener to hold said lock control member to the top half member of said mixing housing allowing said lock control member to move about said fastener so that all said fingers can move simultaneously in and out of said top slots in said cubical cells, and a resilient flat leaf spring engaging said lock control member to apply a force against said lock control member to normally keep said fingers of said lock control member within said top slots of said cubical cells;

(e) a plate transversely mounted across top of said cubical cells and in front of said top slots to protect said fingers of said lock control member; and (f) a plurality of perturabators built within the mixing housing which with adequate volume assures that said spheres are forced into random intermixing even during mild mixer agitations, said top half member of said mixing housing having an aperture placed at the rear thereof and a cap for sealing said aperture after said spheres are placed within said mixing housing, said mixing housing further having at least one inner wall to divide said mixing housing into more than one compartment, each connected to a transparent cubical cell with a plurality of said spheres contained within each said compartment determined by intended lottery game in use.

2. A versatile plurality mixer as recited in claim 1, further comprising:

(a) a stacking member having an open front and a plurality of oblique slots running vertically on one side wall thereon, said stacking member permits secure stacking of a plurality of said mixers within a manner allowing manageable random agitation, mixing, dumping and viewing of multiple combinations of said chance lot spheres for rapid determination and recording of sufficient lottery chances to fill a complete game card as a result of one mixing;

(b) a plurality of joining arms, each of said joining arms connected to each of said lock control members so that each of said lock control members has one extended joining arm extending through one of said oblique slots;

(c) at least two brackets, one said bracket mounted at top of one of said side walls of said stacking member and other said bracket mounted at bottom of same said side wall of said stacking member so that said two brackets are in line with said oblique slots; and (d) a single stack lock control shaft slideably mounted to said brackets and having one said set of joining arms pivotally engaging said shaft so that when said shaft is actuated said joining arms will operate in unison.

* * * * *